US007500671B2

(12) United States Patent
Narus et al.

(10) Patent No.: US 7,500,671 B2
(45) Date of Patent: Mar. 10, 2009

(54) AIR HOCKEY TABLE

(75) Inventors: Michael Narus, Hartford, WI (US); Michael E. Henley, Liberty Township, OH (US)

(73) Assignee: Great Lakes Dart Mfg, Muskego WI (US)

( * ) Notice: Subject to any disclaimer, the term of this patent is extended or adjusted under 35 U.S.C. 154(b) by 16 days.

(21) Appl. No.: 11/562,246

(22) Filed: Nov. 21, 2006

(65) Prior Publication Data

US 2008/0116630 A1 May 22, 2008

(51) Int. Cl.
*A63F 7/07* (2006.01)

(52) U.S. Cl. ..... 273/126 A; 273/108.1

(58) Field of Classification Search ..... 273/126 R, 273/108.1, 118 R
See application file for complete search history.

(56) References Cited

U.S. PATENT DOCUMENTS

| | | | | | |
|---|---|---|---|---|---|
| 2,180,123 | A | * | 11/1939 | Smith | 273/108.1 |
| 3,033,570 | A | * | 5/1962 | Mathes et al. | 273/126 R |
| 3,172,664 | A | * | 3/1965 | Lohr et al. | 273/340 |
| 3,343,793 | A | * | 9/1967 | Waser | 238/10 R |
| 3,480,277 | A | * | 11/1969 | Fraser | 273/108.52 |
| 3,870,303 | A | * | 3/1975 | Patterson, Jr. | 273/108.52 |
| 3,951,408 | A | | 4/1976 | Reiner et al. | |
| 4,076,242 | A | * | 2/1978 | Joseph | 273/108.51 |
| 4,348,026 | A | * | 9/1982 | Kauffmann | 273/126 R |
| 4,407,501 | A | * | 10/1983 | Bates | 273/118 R |
| 5,207,790 | A | * | 5/1993 | Eveillard | 473/29 |
| 5,398,926 | A | | 3/1995 | Skinner | |
| 5,441,455 | A | | 8/1995 | Carruthers | |
| 6,105,960 | A | * | 8/2000 | Carames | 273/108.1 |
| 6,155,564 | A | * | 12/2000 | Tsai | 273/108.1 |
| 6,276,682 | B1 | | 8/2001 | Yamashita et al. | |
| 6,345,820 | B1 | | 2/2002 | Zucchi et al. | |
| 6,764,074 | B2 | | 7/2004 | Bangerter | |
| 6,773,010 | B2 | * | 8/2004 | Zucchi et al. | 273/108.1 |
| 6,840,515 | B2 | * | 1/2005 | Seme | 273/118 R |
| 6,939,256 | B2 | * | 9/2005 | Giacomoni et al. | 473/496 |
| 7,219,892 | B2 | * | 5/2007 | Corrado | 273/108.1 |
| 2003/0116912 | A1 | | 6/2003 | Bangerter | |
| 2004/0173961 | A1 | * | 9/2004 | Seme | 273/118 R |
| 2006/0022403 | A1 | * | 2/2006 | Corrado | 273/108.1 |
| 2006/0082055 | A1 | * | 4/2006 | Chen | 273/126 R |
| 2006/0197278 | A1 | * | 9/2006 | Tsai | 273/108.1 |
| 2006/0284370 | A1 | * | 12/2006 | Chen | 273/108.1 |

* cited by examiner

*Primary Examiner*—Raleigh W. Chiu
(74) *Attorney, Agent, or Firm*—Jansson Shupe & Munger Ltd.

(57) ABSTRACT

An air-hockey table having a playing surface, a plurality of air-conducting openings in the playing surface, a blower supplying air to the openings and a pair of goals, the improvement wherein the playing surface is non-planar and includes a smooth-curved surface having spaced-apart outer playing-surface regions and a central playing region which is lower than the spaced-apart outer playing-surface regions.

33 Claims, 5 Drawing Sheets

FIG. 1
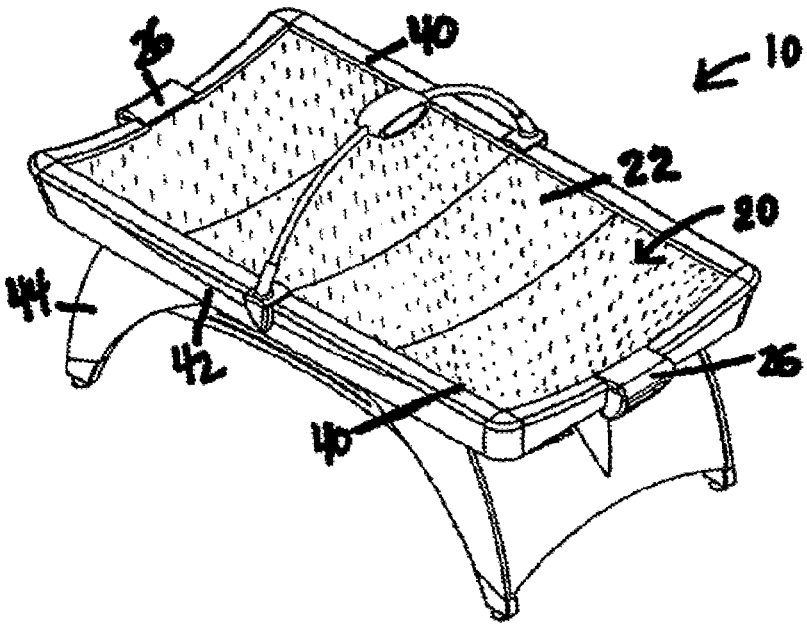
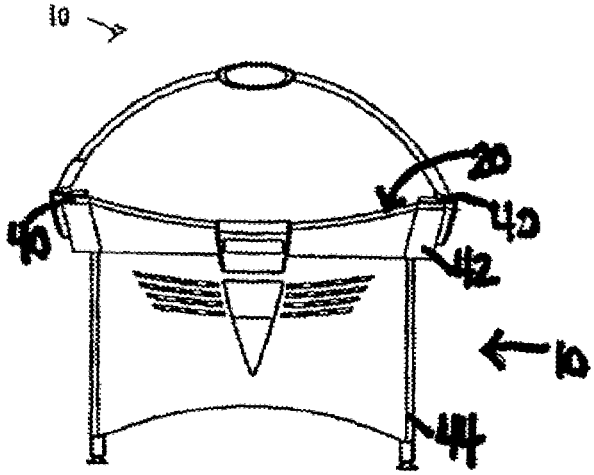
FIG. 2

AIR HOCKEY TABLE

FIELD

The field is related to game tables and, more specifically, to air hockey tables.

BACKGROUND

Many types of air hockey tables are known in the art. Traditional air hockey tables include a planar horizontal playing surface, a plurality of air-conducting openings in the playing surface, a blower supplying air to the openings and a pair of goals.

There is a continuous effort in the field of game tables, including air hockey tables, to create new and exciting challenges to players, including new strategies and game dynamics. Some of the advances in air hockey tables have involved adaptation for more than two players, changes in the playing surface outline, concurrent use of multiple pucks, and revised scoring mechanisms.

Air hockey players often become "addicted" to this fast-paced competitive table game, and are extremely interested in changes and developments in the field. Thus, there has been and remains a demand for novelty and interesting advances in the field. Nonetheless, the basic puck air-cushion action has remained basically unchanged for decades, despite the fact that competitive development efforts have been on-going.

SUMMARY

An improved air-hockey table of the type having a playing surface with a plurality of air-conducting openings therein, a fan or blower supplying air to the openings and a pair of goals is disclosed. The improved table has a playing surface that is a non-planar smooth-curved surface having spaced-apart outer playing-surface regions and a central playing region which is lower than the spaced-apart outer playing-surface regions. The invention is also the non-planar playing surface itself.

Described differently, the invention involves an air-hockey table playing surface having a central playing-surface region which is or includes a lower portion lying below a horizontal reference plane and a pair of spaced-apart outer playing-surface regions lying above the reference plane. Substantially the entire playing surface forms a smooth playing surface.

The term "smooth-curved surface" as used herein means that surface is substantially free of line junctures (creases) which could inhibit free puck movement. The smooth-curved surface could include a plurality of planar surfaces between which are smoothly curved junctures. More preferred forms involve cylindrical surfaces, including as described below. Other possibilities include curvatures which are curved not just in two dimensions, but in three dimensions, such as curvatures involving goal ends being higher than central playing-surface regions, not just outer playing-surface regions being higher than central playing-surface regions.

Preferred embodiments have smooth-curved playing surfaces which are right projections of cylindrical lines. Most highly preferred are surfaces which are cylindrical portions that are right projections of portions of circles—i.e., "cylinders" as most commonly considered. However, the term "cylinder" as used herein means a surface traced by a curved line moving parallel to a fixed straight line—i.e., a right projection of such curved line, regardless of whether the curved line so moving is a portion of an ellipse, parabola, hyperbola or otherwise.

The term "planar" as used herein means flat or lying in a single geometric plane.

In preferred embodiments, the goals are disposed along a central playing-surface axis. Also, the table has a border rail surrounding all or at least portions of the playing surface. The playing surface is preferably rectangular, although in some cases an oval playing surface is preferred. The tables of this invention preferably include a frame supporting the playing surface, and a plurality of legs supporting the frame.

The playing surface, of course, has a width and, when the playing surface is in the preferred circle-cylindrical firm, it has a radius of curvature. In such preferred embodiments, the ratio of the width of the playing surface to the radius of the cylindrical portion is preferably within the range of about 0.3-1.75. It is more preferred that the width-to-radius ratio be within the range of about of about 0.5-0.8. It has been found that the most preferred ratio is about 0.65.

It is important that the curvature of the playing surface be gentle enough such that it does not interfere with substantially free action of the puck over the playing surface. The puck should be substantially continually supported above the playing surface by the air cushion so that it may slide in an almost frictionless manner over the playing surface. The curvature of the playing surface creates interesting gravity effects which significantly increase game interest in causing and watching puck movements. Thus, the curvature should not be so gentle that the action of the puck on the playing surface is not substantially different from that of a planar playing surface. In other words, if the radius of the cylindrical portion becomes too large, the playing surface will become too flat to have any appreciable "bank" play dynamic in the playing surface. In this regard, any curvature in a playing surface that allows a puck to be supported by the air cushion as it hovers over the entire playing surface will have an acceptable radius and degree of curvature.

In the most preferred embodiment, as indicated above, the playing surface is that of a portion of a right circular cylinder. In such cases, when the width (W) of the table and the radius of curvature (R) are known, then the arc ($\theta$, given in degrees) of the curve, the height differential (H) of the playing surface (i.e., change in height from the lowermost point of the playing surface to its highest edge), and the angle of elevation ($\epsilon$) from the middle to the edge can be determined.

One expression of the mathematical relationships is as follows:

$$\sin \theta/2=(1/2)(W/R).$$

For example, if W=48 inches, and R=75 inches, $\sin \theta/2=24/75=0.32$, such that $\theta/2=18.67°$ and $\theta=37.33°$. Thus, with the ratio of width to radius of curvature being 0.64, $\theta=37.33°$, a relationship that holds regardless of the size of the table (big or small).

With the calculated knowledge of arc ($\theta$) of the curve, we can also determined the angle of elevation ($\epsilon$) from the middle to the edge, regardless of the size of the table. The angle of elevation is calculated using the following formula:

$$\epsilon=90-[180-(1/2\theta)]/2$$

or $$2\epsilon=180-[180-(1/2)(37.33)]$$

or $$2\epsilon=18.67°$$

or $$\epsilon=9.34°,$$

which holds regardless of the size of the table.

Finally, knowing the angle of elevation ($\epsilon$), the height differential (H) of the playing surface may be calculated for a table of a particular size using the following equation:

$$\tan \epsilon=H/(\tfrac{1}{2}W)$$

or $$H=\tfrac{1}{2}W(\tan \epsilon).$$

For example, if W=48 inches and R=75 inches, then height differential H=4.04 inches.

If the table is designed with the arc ($\theta$) of a curve of circular cross-section being about 120°, the ratio of width to radius (W/R) is about 1.75. It is believed that greater arcs could be problematic in terms of the interaction of the puck with the air cushion. On the other hand, it is believed that if the ratio of width to radius (W/R) is less than about 0.30, the effect of the invention will not be particularly significant. Excellent game-action effects are available within the preferred ratio range of about of about 0.5-0.8, including at the most highly preferred ratio of about 0.65.

A particularly preferred table width is about 48 inches, and the length of such table is preferably about 84 inches. A so-called "junior" table may have a width of about 32 inches and a length of about 60 inches. Tables in accordance with this invention, including circle-cylindrical tables and other, can be much wider than 48 inches or even narrower than 32 inches. Also, circle-cylindrical tables in accordance with this invention can have radii of curvature which range from fairly small to fairly large, depending on other size factors, including the size of the puck and the spacing and size of air-conducting openings in the table surface. If, for example, the radius of curvature is as little as 36 inches or less, it may be necessary to have a smaller puck in order to preserve appropriate air cushioning of the puck during operation. High radii of curvature do not impose puck cushioning concerns, but may limit unique puck action—again depending on other factors, such as table width, air flow, etc.

In preferred embodiments, the smooth-curved playing surface of the table of this invention will be lower in center playing-surface regions than in outer playing-surface regions. However, variations of the invention may include surfaces having convex portions within a larger concave portion, or convexity in the goal regions. Endless variations are possible within the spirit of this invention, and variations may be made for particular game-action purposes.

The present invention provides new and exciting challenges to air hockey players, including new puck action, new strategies and new game dynamics. The improvement of this invention, rather than being cosmetic in nature, goes straight to the heart of the game action which makes air hockey so attractive to many.

BRIEF DESCRIPTION OF THE DRAWINGS

FIG. 1 is a perspective view of an air hockey table.

FIG. 2 is an end perspective view of the table playing surface of the table in FIG. 1.

DETAILED DESCRIPTION OF PREFERRED EMBODIMENTS

Figure 3:
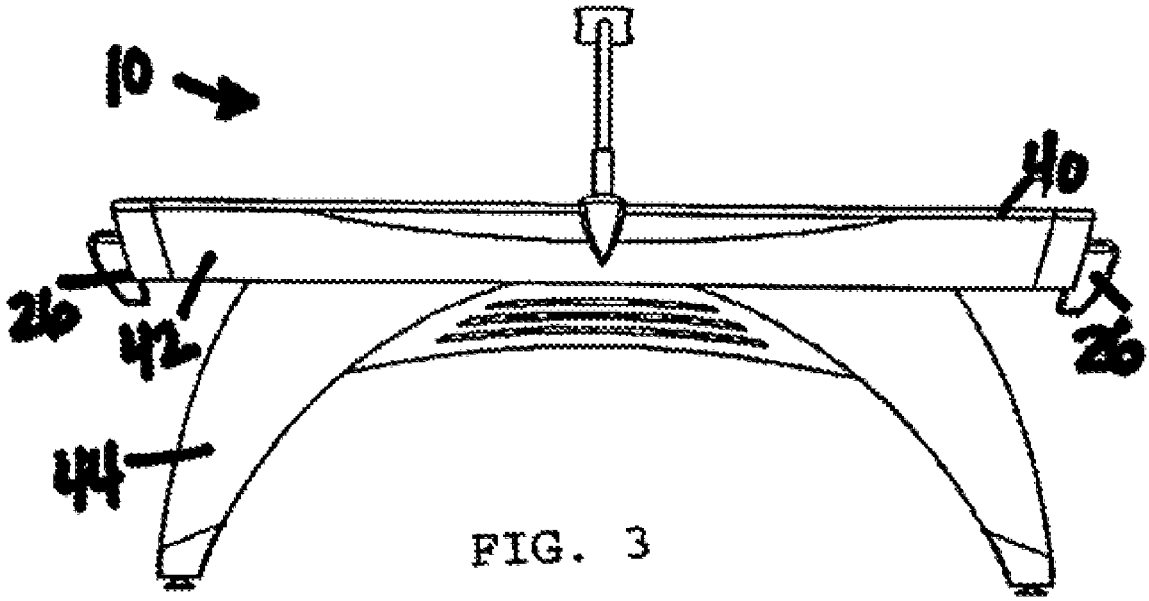
FIG. 3 is a side perspective view of the air hockey table of FIG. 1.
Figure 4:
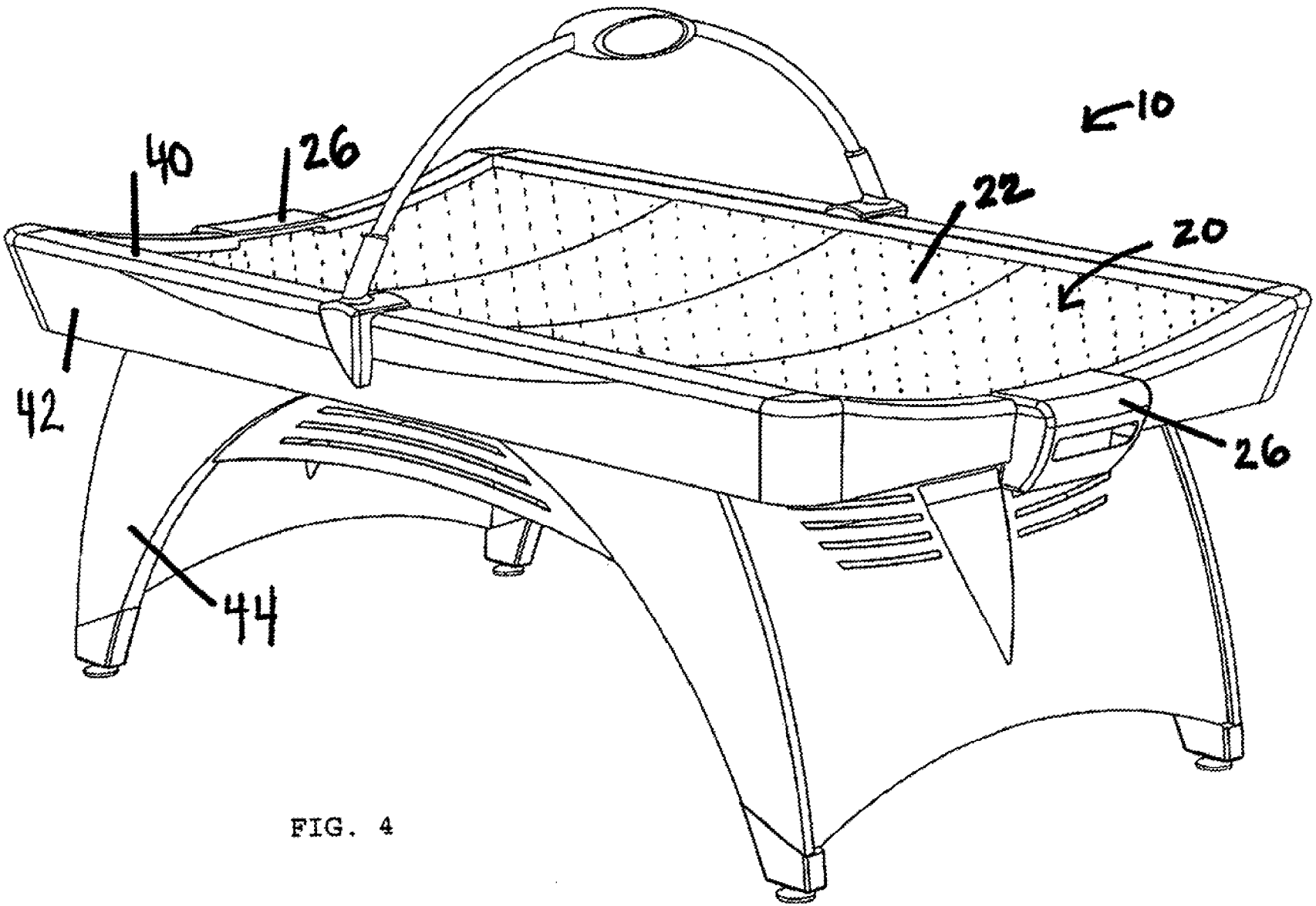
FIG. 4 is another perspective view of the air hockey table of FIG. 1.
Figure 5:
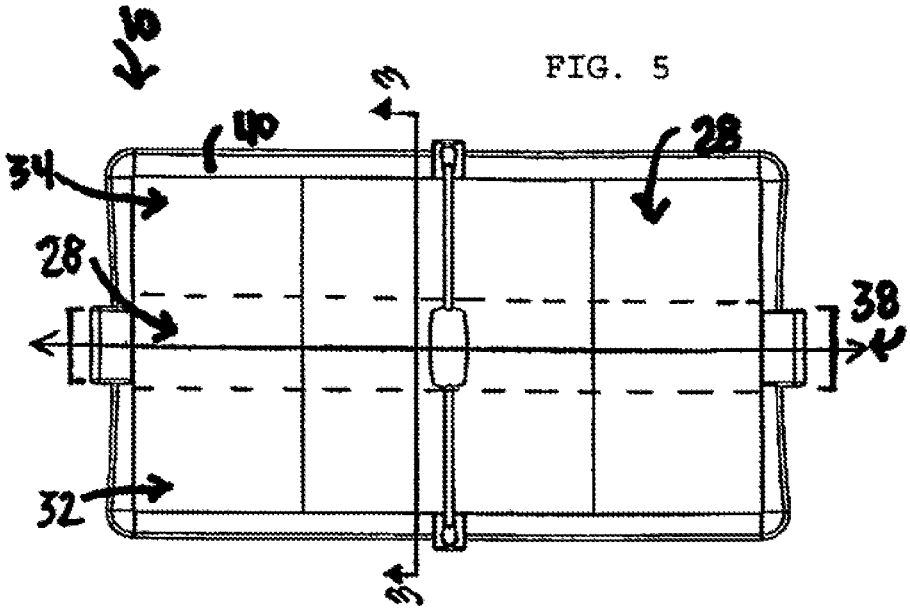
FIG. 5 is top perspective view of the air hockey table of FIG. 1.
Figure 6:
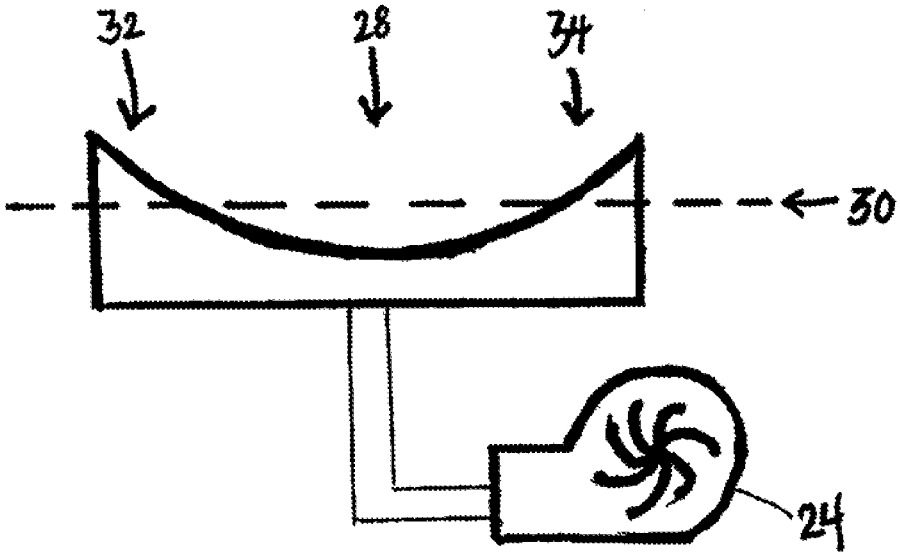
FIG. 6 is a section along section 3-3 of FIG. 5.

FIGS. 1 through 7 illustrate a surface member with a playing surface 20 for use in an air hockey table 10, the surface member defining a plurality of air-conducting openings 22 in playing surface 20 through which air is received from a blower 24. Playing surface 20 comprises: a central playing-surface region 28 including a lower portion lying below a reference plane 30; and a pair of spaced-apart outer playing-surface regions lying above the reference plane, 32 and 34 respectively.

In preferred embodiments, playing surface 20 is a cylindrical portion. The cylindrical portion is of a circular cylinder. The curvature of the cylindrical portion is determined based largely upon the diameter of a standard flat air-hockey puck and the typical spacing of the air-conducting openings 22 in the playing surface as used in the art. Typically, a one-inch grid is the spacing of the air-conducting holes in the playing surface. A standard puck is approximately 2.5 inches diameter and weighs approximately 11 grams. It has a thickness of about 0.2 inches. Where a smaller table is used, the puck will likewise be of a smaller diameter and weight. Other factors that may be considered as impacting the dynamics of game play for the improved playing surface include surface friction and air-flow pressure.

FIGS. 1 through 7 further disclose an air hockey table 10 having a playing surface 20 with a plurality of air-conducting openings 22 in playing surface 20, a blower 24 supplying air to the openings 22 and a pair of goals 26, the improvement in playing surface 20 comprising: 1) a central playing-surface region 28 having a lower portion lying below a reference plane 30; and 2) a pair of spaced-apart outer playing-surface regions lying above the reference plane, 32 and 34 respectively, substantially the entire playing surface 20 forming a smooth-curved surface.

In preferred embodiments, the playing surface is non-planar. As seen best in FIGS. 2 and 6, in preferred embodiments, playing surface 20 is a cylindrical portion. The cylindrical portion is a portion of a circular cylinder. The lower portions are disposed along a central playing-surface axis 38. Table 10 further includes a border rail 40 surrounding at least portions of playing surface 20.

Figure 7:
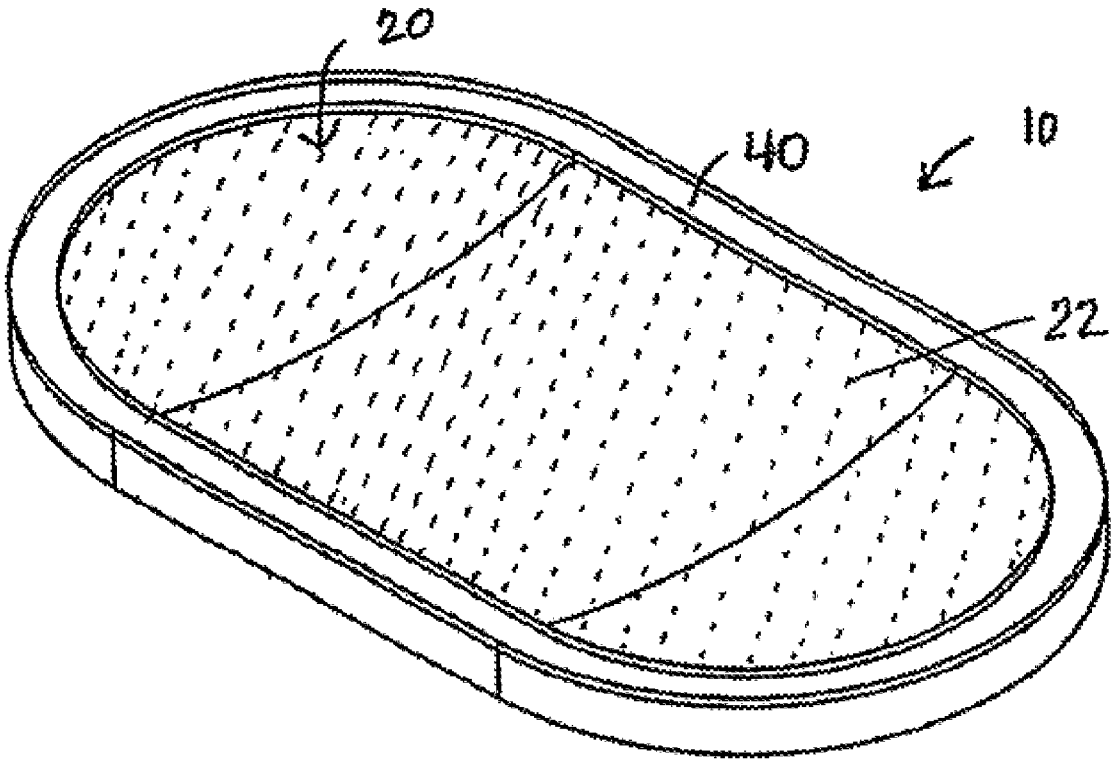
FIG. 7 is a perspective view of an air hockey table having an oval playing surface.

In one embodiment, playing surface 20 is substantially rectangular. FIG. 7 shows, in another embodiment, playing surface 20 is oval.

In at least some embodiments, table 10 includes a frame 42 supporting playing surface 20 and a plurality of legs 44 supporting frame 42.

While the principles of this invention have been described in connection with specific embodiments, it should be understood clearly that these descriptions are made only by way of example and are not intended to limit the scope of the invention.

The invention claimed is:

1. In an air-hockey table having a playing surface with a plurality of air-conducting openings therein, a blower supplying air to the openings and a pair of goals, the improvement wherein the playing surface is non-planar and includes a smooth-curved surface having spaced-apart outer playing-surface regions and a central playing region which is lower than the spaced-apart outer playing-surface regions.

2. The table of claim 1 wherein the playing surface is a cylindrical portion.

3. The table of claim 2 wherein the cylindrical portion is of a circular cylinder.

4. The table of claim 3 wherein the playing surface has a width and the cylindrical portion has a radius, and wherein the ratio of the width of the playing surface to the radius of the cylindrical portion is between about 0.3 and about 1.75.

5. The table of claim 4 wherein the ratio of the width of the playing surface to the radius of the cylindrical portion is between about 0.5 and about 0.8.

6. The table of claim 5 wherein the ratio of the width of the playing surface to the radius of the cylindrical portion is about 0.65.

7. The table of claim 3 wherein the lower portion and goals are disposed along a central playing-surface axis.

8. The table of claim 7 further comprising a border rail surrounding at least portions of the playing surface.

9. The table of claim 8 wherein the playing surface is rectangular.

10. The table of claim 8 wherein the playing surface is oval.

11. The table of claim 8 further comprising:

a frame supporting the playing surface; and a plurality of legs supporting the frame.

12. In an air-hockey table having a playing surface with a plurality of air-conducting openings therein, a blower supplying air to the openings and a pair of goals, the improvement in the playing surface comprising:

a central playing-surface region having a lower portion lying below a reference plane; and a pair of spaced-apart outer playing-surface regions lying above the reference plane, substantially the entire playing surface forming a smooth-curved surface.

13. The table of claim 12 wherein the playing surface is a cylindrical portion.

14. The table of claim 13 wherein the cylindrical portion is of a circular cylinder.

15. The table of claim 14 wherein the playing surface has a width and the cylindrical portion has a radius and wherein the ratio of the width of the playing surface to the radius of the cylindrical portion is between about 0.3 and about 1.75.

16. The table of claim 15 wherein the ratio of the width of the playing surface to the radius of the cylindrical portion is between about 0.5 and about 0.8.

17. The table of claim 16 wherein the ratio of the width of the playing surface to the radius of the cylindrical portion is about 0.65.

18. The table of claim 14 wherein the playing surface is non-planar.

19. The table of claim 18 wherein the lower portions are disposed along a central playing-surface axis.

20. The table of claim 19 further comprising a border rail surrounding at least portions of the playing surface.

21. The table of claim 20 wherein the playing surface is rectangular.

22. The table of claim 20 wherein the playing surface is oval.

23. The table of claim 20 further comprising:

a frame supporting the playing surface; and a plurality of legs supporting the frame.

24. A surface member with a playing surface for use in an air hockey table, the surface member being a cylindrical portion and defining a plurality of air-conducting openings in the playing surface through which air is received from a blower, comprising:

a central playing-surface region having a lower portion lying below a reference plane; and a pair of spaced-apart outer playing-surface regions lying above the reference plane.

25. The table of claim 24 wherein the cylindrical portion is of a circular cylinder.

26. The table of claim 25 wherein the playing surface has a width and the cylindrical portion has a radius and wherein the ratio of the width of the playing surface to the radius of the cylindrical portion is between about 0.3 and about 1.75.

27. The table of claim 26 wherein the ratio of the width of the playing surface to the radius of the cylindrical portion is between about 0.5 and about 0.8.

28. The table of claim 27 wherein the ratio of the width of the playing surface to the radius of the cylindrical portion is about 0.65.

29. In a table hockey game table having a playing surface and a pair of goals, the improvement wherein the playing surface is of a non-planar, cylindrical portion and includes a smooth-curved surface having spaced-apart outer playing-surface regions and a central playing region which is lower than the spaced-apart outer playing-surface regions.

30. The table of claim 29 wherein the cylindrical portion is of a circular cylinder.

31. The table of claim 30 wherein the playing surface has a width and the cylindrical portion has a radius and wherein the ratio of the width of the playing surface to the radius of the cylindrical portion is between about 0.3 and about 1.75.

32. The table of claim 31 wherein the ratio of the width of the playing surface to the radius of the cylindrical portion is between about 0.5 and about 0.8.

33. The table of claim 32 wherein the ratio of the width of the playing surface to the radius of the cylindrical portion is about 0.65.

* * * * *